United States Patent [19]

Robinson

[11] Patent Number: 4,730,737

[45] Date of Patent: Mar. 15, 1988

[54] PORTABLE CLOTHES HANGER RACK

[76] Inventor: Edward Robinson, 388 Braeside Ave., E. Stroudsburg, Pa. 18301

[21] Appl. No.: 876,723

[22] Filed: Jun. 20, 1986

[51] Int. Cl.[4] ..... A47F 5/08

[52] U.S. Cl. ..... 211/113; 211/94; 211/118; 223/94

[58] Field of Search ..... 211/113, 118, 94, 162; 223/94, 89, 85

[56] References Cited

U.S. PATENT DOCUMENTS

| | | | |
|---|---|---|---|
| 1,420,534 | 6/1922 | Everitt | 211/94 |
| 2,714,966 | 8/1955 | Tieck | 211/94 |
| 2,813,634 | 11/1957 | Andersson | 211/94 |
| 2,941,704 | 6/1960 | Slutzky | 223/94 |
| 3,179,256 | 4/1965 | Underwood | 211/118 |
| 4,231,499 | 11/1980 | Smith | 223/94 |
| 4,333,575 | 6/1982 | Wong | 211/118 |
| 4,474,316 | 10/1984 | Philibert | 223/85 X |

FOREIGN PATENT DOCUMENTS

| | | | |
|---|---|---|---|
| 693782 | 9/1964 | Canada | 211/118 |
| 487675 | 12/1953 | Italy | 211/94 |
| 518462 | 3/1940 | United Kingdom | 223/94 |

*Primary Examiner*—Ramon S. Britts
*Assistant Examiner*—Blair M. Johnson
*Attorney, Agent, or Firm*—Ruth Moyerman

[57] ABSTRACT

A portable clothes hanger rack is disclosed. A yoke has a hook at one end and a pair of pivotable arms mounted on the other end. The hook is used to suspend the device while the arms hold a plurality of hangers. The hangers are modified with a sphere replacing the conventional hanger hook. The arms have a removable end and the top, bottom and side wall form an enclosed elongated parallelpiped. The arm bottom wall has an elongated slot and the hangers extend down through the slot with the sphere retained inside the arm. The arms may be folded into a vertically parallel coextensive position for compact storage of the device in a suitcase.

1 Claim, 3 Drawing Figures

PORTABLE CLOTHES HANGER RACK

BACKGROUND OF THE INVENTION

1. Field of the Invention

This invention relates to garment hanging devices and more particularly to devices which include a plurality of garment hangers carried by a single hook member.

2. Description of the Prior Art

Many devices are known whose purpose is to function as a garment hanging device with a multiplicity of hangers supported from a single hook. U.S. Pat. No. 2,454,559 to Kuehn is an example of a collapsible drying rack. U.S. Pat. No. 3,584,746 to Marchman is an example of a multiple garment hanger. U.S. Pat. No. 4,058,222 to Singer is an example of a multiple clothes hanging device. Although these devices are portable, they tend to be cumbersome as the number of hangers is increased.

There is therefore a need for a truly portable garment hanger rack which is compact enough to fit in a suitcase, but which is capable of holding a large number of garments.

SUMMARY OF THE INVENTION

The aforementioned prior art problems are overcome by the portable clothes hanger rack of this invention. The instant portable clothes hanger rack has a supporting structure which is yoke-like design. One end of the yoke has a hook to suspend the device in use. At the end opposite the hook, two arms are mounted to the yoke with a hinge-like pivot which allows both arms to move from a vertical to a horizontal position. The arms are designed to retain a number of hangers which have a sphere in place of the conventional hanger hook. The arms preferably have a rectangular cross section with a longitudinal slot along the bottom side, and a hinged end.

Hangers may be inserted and removed through the end, and the sphere-shaped heads allow the hangers to slide along the slot. The hanger neck and body extend downward through the slot, allowing garments to be hung on them.

A locking mechanism retains the arms in a horizontally extended position. The arms may be folded into a vertically parallel alignment after the locking mechanism is released for removal of the hangers for compact storage of the rack in a suitcase or other space limited area. In use, when the rack may carried fully loaded with garments, the arms will hang down in a generally inverted V shape which is convenient for the user in maneuvering doors, etc.

It is therefore an object of this invention to provide a portable clothes hanger rack which may be carried compactly in a suitcase.

It is another object of this invention to provide a portable clothes hanger rack which is light in weight but can support a large number of hangers.

It is still another object of this invention to provide a portable clothes hanger rack which can be used to store clothing in a space limited area.

It is yet another object of this invention to provide a portable clothes hanger rack which is easily and inexpensively manufactured with conventional materials and methods.

These and other objects will be more readily ascertainable to one skilled in the art from a consideration of the following figures, description and exemplary embodiments.

BRIEF DESCRIPTION OF THE DRAWING(S)

DETAILED DESCRIPTION OF THE PREFERRED EMBODIMENT(S)

Figures 1, 2, 3:
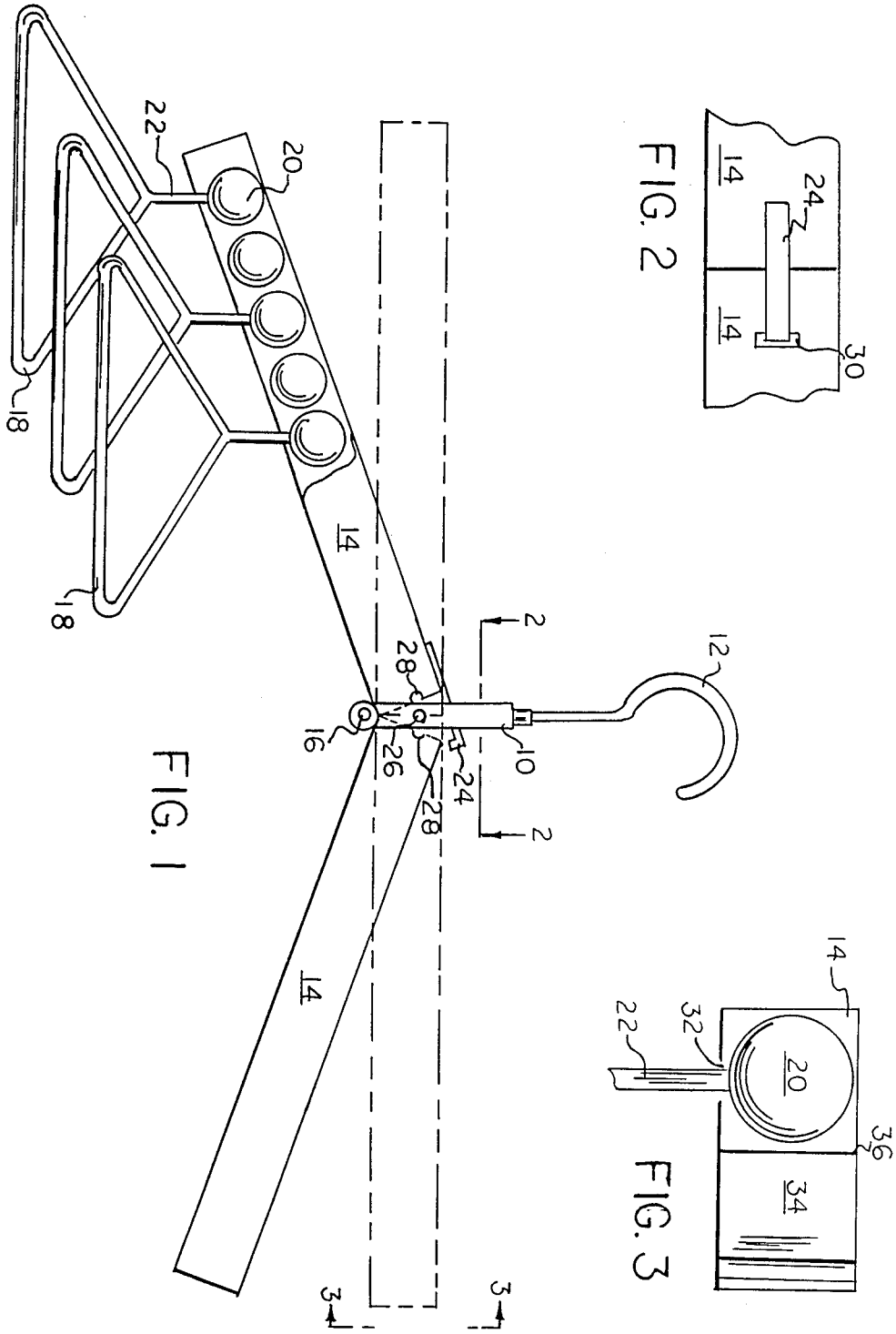
FIG. 1 is a front elevation of the device in a partially folded position, or in-use carrying position, the horizontally extended position shown in phantom.
FIG. 2 is a top view of the latch mechanism taken along lines 2—2 of FIG. 1.
FIG. 3 is a close-up view of the arm end taken along lines 3—3 of FIG. 1.

Referring now to FIG. 1, the portable clothes hanger rack of this invention is shown in use with yoke 10 having self retention means hook 12 mounted at one end. Arms 14 are pivotably mounted to the opposite end of yoke 10 by means of a modified hinge 16. Hangers 18 are removably retained within arms 14 by means of a sphere 20 mounted at the apex of hanger neck 22. In this view, for clarity, only every other hanger is shown; whereas, in fact, each sphere 20 would include a hanger 18.

Hanger neck 22 extends through the longitudinally slotted bottom of arm 14 (not shown) so that clothing may be hung on hanger 18. When arms 14 are fully extended in the horizontal position (shown in phantom), latch mechanism hook 24 engages a hook retention means on opposite arm 14, locking both arms 14 together to provide structural support to both arms 14. When arms 14 are locked in the horizontally extended position, additional structural strength and stability is provided by pin 26 which is mounted transversely through yoke 10 and which engages notches 28 located on the ends of arms 14. Pin 26 engaging notches 28 prevents arms 14 from twisting and inadvertently unlatching latch mechanism hook 24.

When the portable clothes hanger rack is to be stored, latch mechanism hook 24 is disengaged from the retention means and arms 14 pivot at the modified hinge 16 to a coextensive vertical position.

Referring now to FIG. 2, a top view of the latch mechanism taken along lines 2—2 of FIG. 1 is shown. Latch mechanism hook 24, mounted on the top of one arm 14, is engaged by a hook retention means 30 shown here as a slot. The latch mechanism secures arms 14 in a horizontally extended position until latch mechanism hook 24 is released from hook retention means 30. This allows arms 14 to pivot into the vertically coextensive storage position.

Referring now to FIG. 3, a close-up view of arm 14's end taken along lines 3—3 of FIG. 1, is shown. Hanger neck 22 is shown extending downward from arm 14 through longitudinal slot 32. Sphere 20 is retained within arm 14 by pivotable end cover 34, attached to arm 14 by means of hinge 36, and which may be opened to add or remove hangers 18. When pivotable end cover 34 is secured covering arm 14's end, spheres 20 are retained within arm 14. Securing means may be a press or snap fit or any other conventional latch means.

There are many variations which may be practiced within the scope of this invention. For example, while hanger 18 is shown having a hanger retention means in the configuration of a sphere 20, other configurations or hangers and arms may be used, such as triangular or square, and still be within the scope of this invention.

Although pivotable end cover 34 is secured to arms 14 by means of hinge 36, other retention methods may be used such as a spring biased retainer and still be within the scope of this invention.

The device of this invention has many advantages. Chiefly among these is the compact, light weight, portability of the device.

Secondly, the device may hold as many as thirty hangers and garments and still be easily carried when full.

Thirdly, the portable clothes hanger rack may be used in a space limited area without a reduction in the hanger capacity.

Fourth, the device can be easily manufactured using conventional materials and methods.

Having now illustrated and described my invention, it is not intended that such description limit the invention, but rather that this invention be limited only by a reasonable interpretation of the appended claims.

What is claimed is:

1. A portable clothes hanger rack comprising:

(a) a generally rectangular yoke, one end of said yoke including a hook for self retention;

(b) a pair of hollow elongated parallelpipedal arms pivotably mounted to said yoke proximate said yoke's other end, each said arm including a first end and a second end, two sides, and top and bottom walls, said first end hingeably attached to said yoke and including a notch, said second arm end including a removable cover hinged to said second end, said bottom wall including a longitudinal slot to receive hanger necks;

(c) a plurality of hangers, each said hanger including a neck and a sphere mounted at the apex of said neck, said sphere sized to be movably retained in said arm's hollow interior through said second arm end with said hanger neck slidably received in said arm bottom wall's slot;

(d) a latch mechanism to secure said arms in a plane perpendicular to said yoke, said latch mechanism including (i) a hook mounted on said top wall of one arm proximate said arm's first end; and, (ii) hook retention means mounted on said top wall of said opposite arm proximate said opposite arm's first end; and, (e) a pin transversely mounted through said yoke at a point such that when said arms are horizontal, said notches face each other and overfit said pin, thereby stabilizing said arms in the horizontally extended position.

* * * * *